US011529554B2

(12) United States Patent
Lim

(10) Patent No.: US 11,529,554 B2
(45) Date of Patent: Dec. 20, 2022

(54) BOWLING GAME APPARATUS FOR FLYING DISC

(71) Applicant: Tae Kweon Lim, Jeonju-si (KR)

(72) Inventor: Tae Kweon Lim, Jeonju-si (KR)

( * ) Notice: Subject to any disclaimer, the term of this patent is extended or adjusted under 35 U.S.C. 154(b) by 0 days.

(21) Appl. No.: 17/414,302

(22) PCT Filed: Dec. 12, 2019

(86) PCT No.: PCT/KR2019/017591
§ 371 (c)(1),
(2) Date: Jun. 15, 2021

(87) PCT Pub. No.: WO2020/130487
PCT Pub. Date: Jun. 25, 2020

(65) Prior Publication Data

US 2022/0016512 A1 Jan. 20, 2022

(30) Foreign Application Priority Data

Dec. 21, 2018 (KR) ..... 10-2018-0167157

(51) Int. Cl.

| | |
|---|---|
| ***A63D 5/08*** | (2006.01) |
| ***A63D 1/08*** | (2006.01) |
| ***A63D 5/06*** | (2006.01) |
| ***A63H 33/18*** | (2006.01) |

(52) U.S. Cl.
CPC ..... *A63D 5/08* (2013.01); *A63D 1/08* (2013.01); *A63D 5/06* (2013.01); *A63H 33/18* (2013.01); *A63D 2005/086* (2013.01)

(58) Field of Classification Search
CPC ... A63D 5/08; A63D 1/08; A63D 5/06; A63D 2005/086; A63H 33/18
See application file for complete search history.

(56) References Cited

U.S. PATENT DOCUMENTS 270,088 A * 1/1883 Markees ..... A63D 5/08 473/79
460,025 A * 9/1891 Von Oeyen ..... A63D 5/08 473/80

(Continued)

FOREIGN PATENT DOCUMENTS

JP 2000153012 A 6/2000
JP 2002291957 A 10/2002

(Continued)

OTHER PUBLICATIONS

ISA Korean Intellectual Property Office, International Search Report Issued in Application No. PCT/KR2019/017591, dated Apr. 1, 2020, WIPO, 4 pages.

*Primary Examiner* — William M Pierce
(74) *Attorney, Agent, or Firm* — McCoy Russell LLP

(57) ABSTRACT

The present invention relates to a bowling game apparatus for a flying disc and, more particularly, to a bowling game apparatus, for a flying disc, which is automated such that a user does not have to set bowling pins and recover a thrown flying disc. Since the user does not have to set the bowling pins and recover the flying disc, user convenience is enhanced. The bowling game apparatus has a simple structure and thus can be manufactured at a low cost and can easily be installed in a limited space.

8 Claims, 9 Drawing Sheets

(56) References Cited

U.S. PATENT DOCUMENTS 514,673 A * 2/1894 Danquard ..... A63D 5/08 473/79
808,959 A * 1/1906 Vinsen et al. ..... A63D 5/08 473/80
1,630,440 A * 5/1927 Lloyd ..... A63D 5/08 473/82
2,048,915 A * 7/1936 Bayer ..... A63F 7/2409 473/80
2,188,740 A * 1/1940 Rietschel ..... A63D 3/00 473/79
2,469,886 A * 5/1949 Murphy ..... A63D 5/08 473/94
3,275,325 A * 9/1966 Mackenzie ..... A63B 57/405 273/125 R
3,401,937 A * 9/1968 Rockwood ..... F41J 3/0004 250/222.2
3,975,014 A * 8/1976 Ryan ..... A63D 5/08 473/80
4,330,130 A * 5/1982 Carr ..... A63F 9/0204 273/393
4,378,944 A * 4/1983 Johnston ..... A63F 9/0204 473/79
7,166,045 B1 * 1/2007 Linner ..... A63B 63/007 446/422
2002/0067001 A1 * 6/2002 McClung ..... A63H 33/18 273/317
2002/0098896 A1 * 7/2002 Rieber ..... A63D 15/04 473/10
2007/0287549 A1 * 12/2007 Ochi ..... A63D 5/00 473/55
2022/0016512 A1 * 1/2022 Lim ..... A63D 1/04

FOREIGN PATENT DOCUMENTS

JP 2010063672 A 3/2010
KR 20030029343 A 4/2003
KR 101109400 B1 1/2012

* cited by examiner

BOWLING GAME APPARATUS FOR FLYING DISC

CROSS REFERENCE TO RELATED APPLICATIONS

The present application is a U.S. National Phase of International Application No. PCT/KR2019/017591 entitled "BOWLING GAME APPARATUS FOR FLYING DISC," and filed on Dec. 12, 2019. International Application No. PCT/KR2019/017591 claims priority to Korean Patent Application No. 10-2018-0167157 filed on Dec. 21, 2018. The entire contents of each of the above-listed applications are hereby incorporated by reference for all purposes.

TECHNICAL FIELD

The present invention relates to a bowling game apparatus for a flying disc, and more particularly, to an automated bowling game apparatus for a flying disc so that a user does not directly set a bowling pin and collect a thrown flying disc.

BACKGROUND AND SUMMARY

A flying disc is a circular plate-shaped ride that anyone of all ages may easily throw and receive in the open air and two or more people may enjoy. The flying disc has been popularized and known as official sports events using a flying disc, such as an ultimate game and a disc golf game, which are the currently official sports events.

In general, a game using a flying disc is limited to a game where two or more users throw a flying disc and exchange the flying disc with the third party or a game such as throwing the flying disc on a specific target plate and hitting the specific target plate. Accordingly, Japanese Laid-Open Patent Publication No. 2010-063672 (Water bowling equipment and beach bowling equipment, Sep. 11, 2010) discloses a mechanism for playing a game in which a player whose lower body is submerged underwater throws a disc-shaped disc to a bowling pin erected in a position spaced apart by a predetermined distance and hits the bowling pin.

However, the conventional bowling game apparatus using a flying disc is based on a method of throwing a flying disc after a user directly erects a bowling pin, and has a problem in that since the thrown flying disc is not set to be automatically recovered or bowling pins that are collapsed by being hit with the flying disc are not set to be automatically erected, a user needs to directly set the bowling pins and collect the flying disc.

DISCLOSURE

Technical Problem

The present invention has been conceived to solve the above problems, and is to provide an automated bowling game apparatus for a flying disc so that a user does not directly set a bowling pin and collect a thrown flying disc.

Technical Solution

In order to solve the above-described problem, the present invention provides an automated bowling game apparatus that includes a recovery conveyor configured to drop a thrown flying disc downward and automatically collect the dropping flying disc, and drops a flying disc seated on a bowling pin that has been hit and collapsed to a recovery conveyor using rotation, vibration, air injection, and the like.

Advantageous Effects

According to the configuration described above, the present invention has an advantage in that the user need not directly set the bowling pin and collect the flying disc to increase the user's convenience and the bowling game apparatus has a simple structure to be manufactured at low cost and to be easily installed in a narrow space.

DETAILED DESCRIPTION

Best Mode

Figure 1:
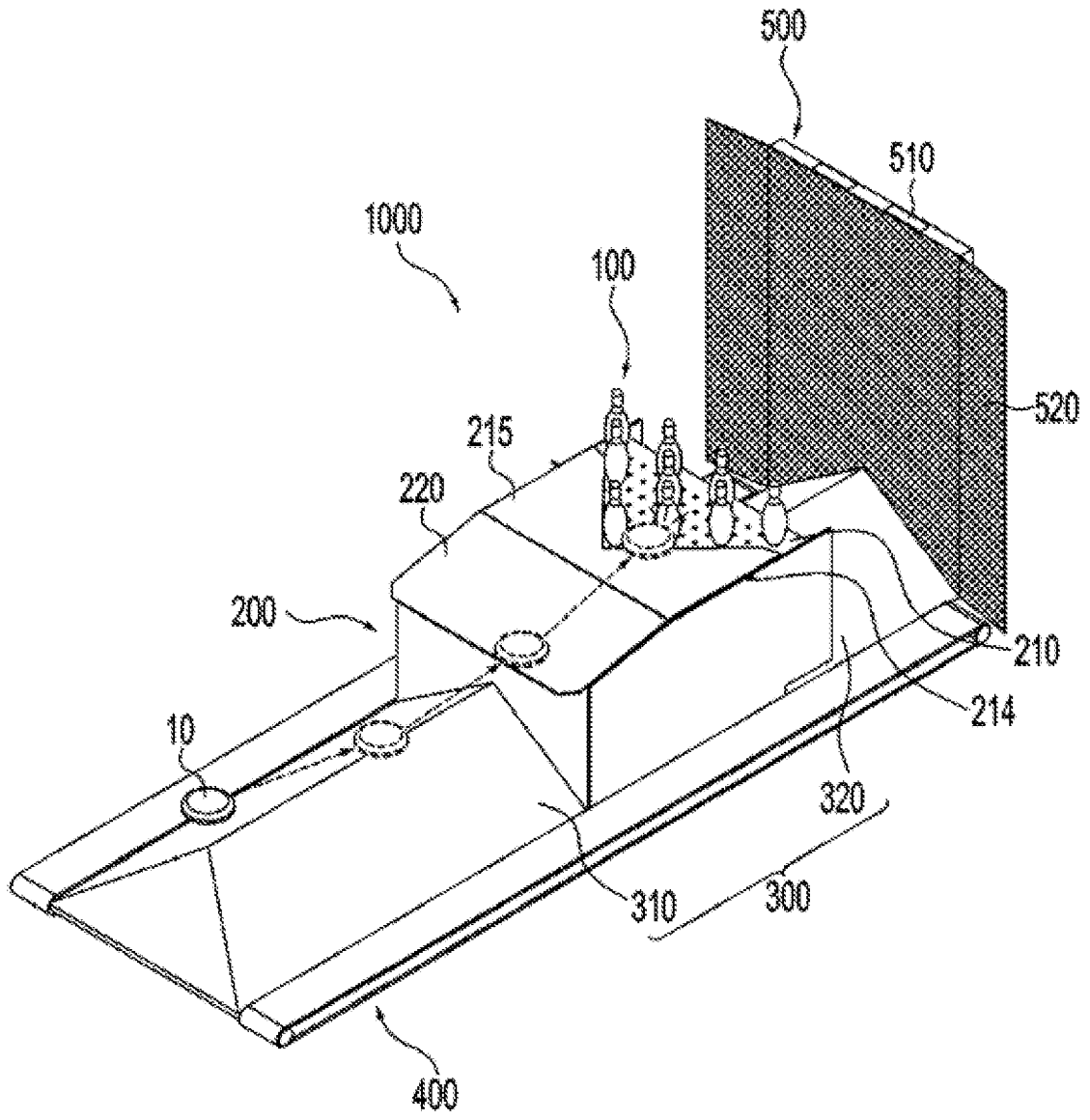
FIGS. 1 and 2 are perspective views illustrating a bowling game apparatus according to an embodiment of the present invention.

In one general aspect, a bowling game apparatus for a flying disc configured to automatically collect the flying disc that hits bowling pins erected spaced apart at a certain distance and then is dropped, includes: a body part configured to include a pin deck having a pin insertion groove inserted thereinto for erecting a bowling pin on an upper surface thereof; a swash plate provided on at least one of a front or a rear of the body part and having an inclined surface inclined at a predetermined angle with a ground; and a recovery conveyor configured to be provided in a lateral direction of the body part and the swash plate to collect the flying disc dropping by the swash plate.

The pin deck may further include a rotation shaft extending in the lateral direction so that both ends thereof are rotatably fixed to the body part, in which the pin deck may be rotated in front and rear directions with respect to the rotation shaft to drop the flying disc seated on the pin deck onto the swash plate.

The bowling game apparatus may further include: a pin setter unit configured to set the bowling pin erected on the pin deck and to prevent the bowling pin from being separated when the pin deck rotates, including a winding motor that applies tension to the pin up string connected to the bowling pin, in which the pin deck may further include a through hole perforated so that a pin up string connected to a lower portion of the bowling pin penetrates downward of the pin insertion groove.

The pin deck may further include a plurality of air injection holes formed to inject air of a predetermined pressure upward when rotating in the front and rear directions to cause the flying disc that has not dropped after the rotation of the pin deck to deviate from the pin deck.

The body part may further include a vibrator configured to vibrate the pin deck in a lateral direction when the pin deck rotates in the front and rear directions to cause the flying disc that has not dropped after the rotation of the pin deck to deviate from the pin deck.

The body part may further include a skip board configured to be provided in front of the pin deck and formed so that a front portion thereof is inclined downward by a predetermined angle.

The swash plate may include a front swash plate provided in front of the body part and a rear swash plate provided at a rear of the body part, and the pin deck may be driven to rotate backward, and the skip board is driven to rotate forward.

The rear swash plate may further include a collision prevention surface that is formed so that a front portion thereof is inclined at a predetermined angle in order to prevent the collision with the rotating pin deck.

The pin deck may further include a passage guide block formed to surround a front side of a plurality of bowling pins aligned to have a predetermined height and spaced apart from each other by a predetermined distance.

The bowling game apparatus may further include: a dropping wall configured to be provided in at least one of rear or side directions of the body part, the swash plate, and the recovery conveyor to drop the flying disc deviated without hitting the bowling pin onto the swash plate or the recovery conveyor.

The dropping wall may further include a shock absorbing member provided on an inner side surface of the dropping wall to absorb the shock of the hitting flying disc.

The pin insertion groove of the pin deck may include a stepped portion in which an outer side portion of a cross section in a vertical direction is vertically formed, and a curved portion in which an inner side portion of the cross-section is formed to be recessed downward.

MODE FOR INVENTION

The present invention may be variously modified and have several exemplary embodiments. Therefore, specific exemplary embodiments of the present invention will be illustrated in the accompanying drawings and be described in detail. However, it is to be understood that the present invention is not limited to a specific exemplary embodiment, but includes all modifications, equivalents, and substitutions without departing from the scope and spirit of the present invention.

It is to be understood that when one component is referred to as being "connected to" or "coupled to" another component, one component may be connected directly to or coupled directly to another component or be connected to or coupled to another component with the other component interposed therebetween.

Unless indicated otherwise, it is to be understood that all the terms used in the specification including technical and scientific terms have the same meaning as those that are generally understood by those who skilled in the art.

It should be understood that the terms defined by the dictionary are identical with the meanings within the context of the related art, and they should not be ideally or excessively formally defined unless the context clearly dictates otherwise.

Hereinafter, a technical spirit of the present invention will be described in more detail with reference to the accompanying drawings.

However, the accompanying drawings are only examples shown in order to describe the technical idea of the present invention in more detail. Therefore, the technical idea of the present invention is not limited to shapes of the accompanying drawings.

Figure 2:
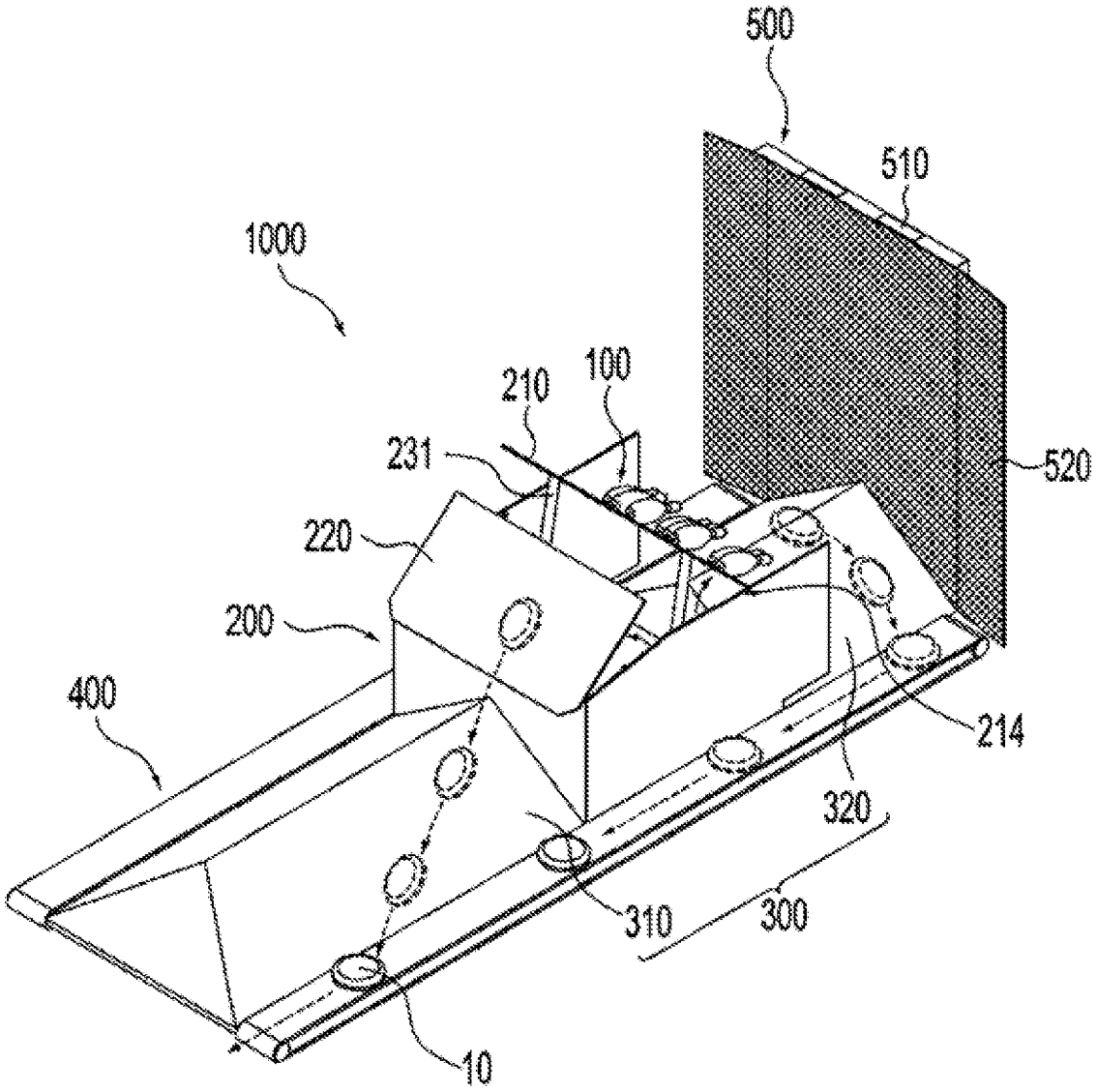
Figure 3:
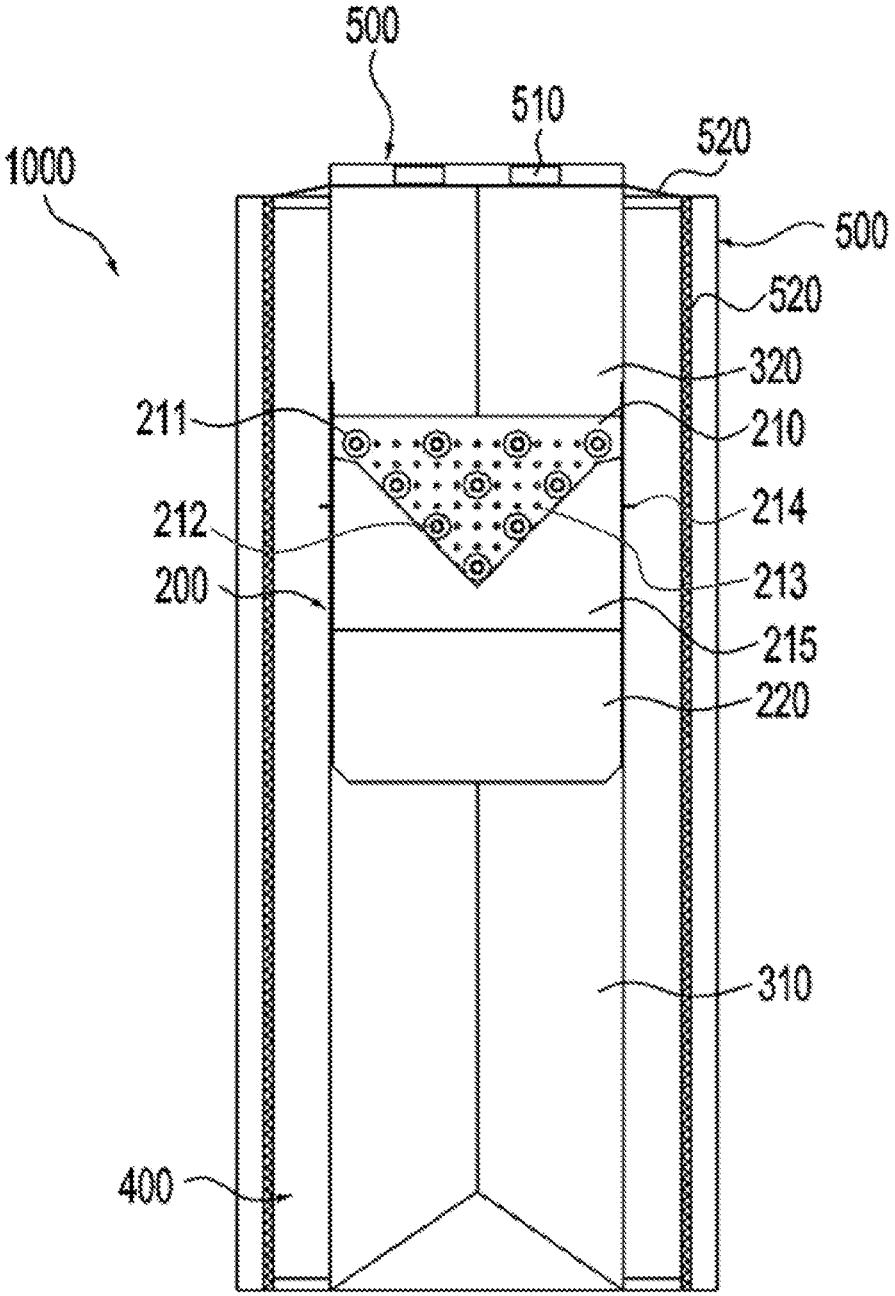
FIG. 3 is a plan view illustrating the bowling game apparatus according to the embodiment of the present invention, but the bowling pins are not shown in FIG. 3.

FIGS. 1 and 2 are perspective views illustrating a bowling game apparatus according to an embodiment of the present invention, and FIG. 3 is a plan view illustrating the bowling game apparatus according to the embodiment of the present invention. Referring to FIGS. 1 to 3, a bowling game apparatus 1000 according to the embodiment of the present invention may be configured to include a bowling pin 100, a body part 200, a swash plate 300, a recovery conveyor 400, and a dropping wall 500. After the flying disc 10, which is thrown toward the bowling pin erected on a pin deck 210 provided on the upper surface of the body part 200, hits the bowling pin 100, the flying disc 10 drops to the recovery conveyor 400 by the swash plate inclined at a predetermined angle with respect to the ground and is automatically recovered and is automatically recovered, so there is no need for a user to collect the flying disc directly, which increases the user's convenience and makes it possible to enjoy the bowling game more conveniently.

In more detail, the body part 200 includes the pin deck 210 provided with a pin insertion groove 211 for erecting the bowling pin 100, and due to the nature of the flying disc that is thrown from a user and flies, it is preferable that the upper surface on which the pin deck 210 is provided is formed so as to be spaced apart from the ground by a predetermined height. In this case, the pin deck 210 has 10 pin insertion grooves 211 spaced apart from each other by a certain distance provided on the upper surface thereof, and the 10 bowling pin 100 are inserted into the 10 pin insertion grooves 211 and erected, so a user may play a bowling game in which he/she throws the flying disc toward the bowling pin 100 and the thrown flying disc 10 hits the bowling pin 100, thereby collapsing the bowling pin 100. In this case, the number and alignment of pin insertion grooves 211 provided in the pin deck 210 are not limited to the illustrated shape, and various modifications may be made without departing from the gist of the present invention.

In addition, the body part 200 may further include a skip board 220 that is provided in front of the pin deck 210 in a direction in which the flying disc 10 flies, prevents the flying disc 10, which is thrown from the user and flies, from dropping by hitting the front surface of the body part 200, and guides the hitting flying disc to fly upward so as to hit the bowling pin 100. In this case, the skip board 220 is formed to have a slope inclined downward by a predetermined angle, so the flying disc 10 is guided to slide along the upper surface of the inclined skip board 220 to fly upward. As a result, the flying disc 10 is prevented from dropping by hitting the front surface of the body part 200, and the flying disc 10 hitting the bowling pin 100 is seated in front of the body part 200 so that the flying disc is prevented from dropping downward and then a progress path of the thrown flying disc is prevented from being obstructed.

The swash plate 300 is configured to guide the flying disc 10 hitting the bowling pin 100 to the recovery conveyor 400, and may be provided on at least one of the front or the rear of the body part, and provided to have an inclined surface forming a predetermined angle with respect to the ground. The swash plate 300 is formed to be located at a lower position from the ground than the pin deck 210 of the body part 200, and the pin deck 210 or the flying disc 10 dropping from the dropping wall 500 slides downward along the inclined surface forming the predetermined angle with respect to the ground to drop to the recovery conveyor 400 provided in a lateral direction of the body part and the swash plate. In addition, the swash plate 300 is formed in a shape having a triangular cross-section in the front and rear directions to guide the flying disc 10 dropping to the swash plate 300 to drop in the lateral direction in left and right directions, and the angle with respect to the ground is formed at an acute angle. In this case, the shape of the swash plate 300 may be modified to have various shapes or forms without departing from the gist of the present invention for guiding the dropping flying disc 10 to the recovery conveyor 400.

The recovery conveyor 400 is configured to transporting and recovering the flying disc 10 slid downward along the swash plate 300 to the front. Preferably, the recovery conveyor 400 may be configured by a conveyor aligned in the front and rear directions and belt-driven. However, the shape and driving means of the recovery conveyor 400 are not limited and the recovery conveyor 400 may be modified in various forms to transport and recover the flying disc 10 to the front.

When the thrown flying disc 10 fails to hit on the bowling pin 100 and deviates from the path to the rear or the side, the dropping wall 500 is configured to guide the deviating flying disc 10 to the recovery conveyor 400. As illustrated in FIG. 3, it is preferable that the dropping wall 500 may be provided in a lateral direction including the rear direction or left and right directions of the body part, the swash plate, and the recovery conveyor, and the dropping wall 500 is configured to have a higher height from the ground than the body part 200 to prevent the flying disc 10 from deviating. In this case, as the dropping wall 500 is formed high in a vertical direction, the dropping wall 500 is configured to be robust against the impact of the hitting flying disc 10, including a pillar 510 for supporting a weight, and prevents the flying disc 10 hitting the dropping wall 500 from being bounced away and interfering with the body part 200. The dropping wall 500 may be formed to have a slope inclined to the outside from the inside in which the body part 200, the swash plate 300, and the recovery conveyor 400 are provided so that the flying disc 10 slides to the recovery conveyor 400.

In addition, the dropping wall 500 may be configured to further include a shock absorbing member 520 for absorbing the shock of the flying disc 10 on an inner side surface in the direction in which the body part 200, the swash plate 300, and the recovery conveyor 400 are provided. In this case, the shock absorbing member 520 may be modified into various materials including a mesh or a sponge having viscoelasticity, rubber, urethane, and the like.

Figure 4:
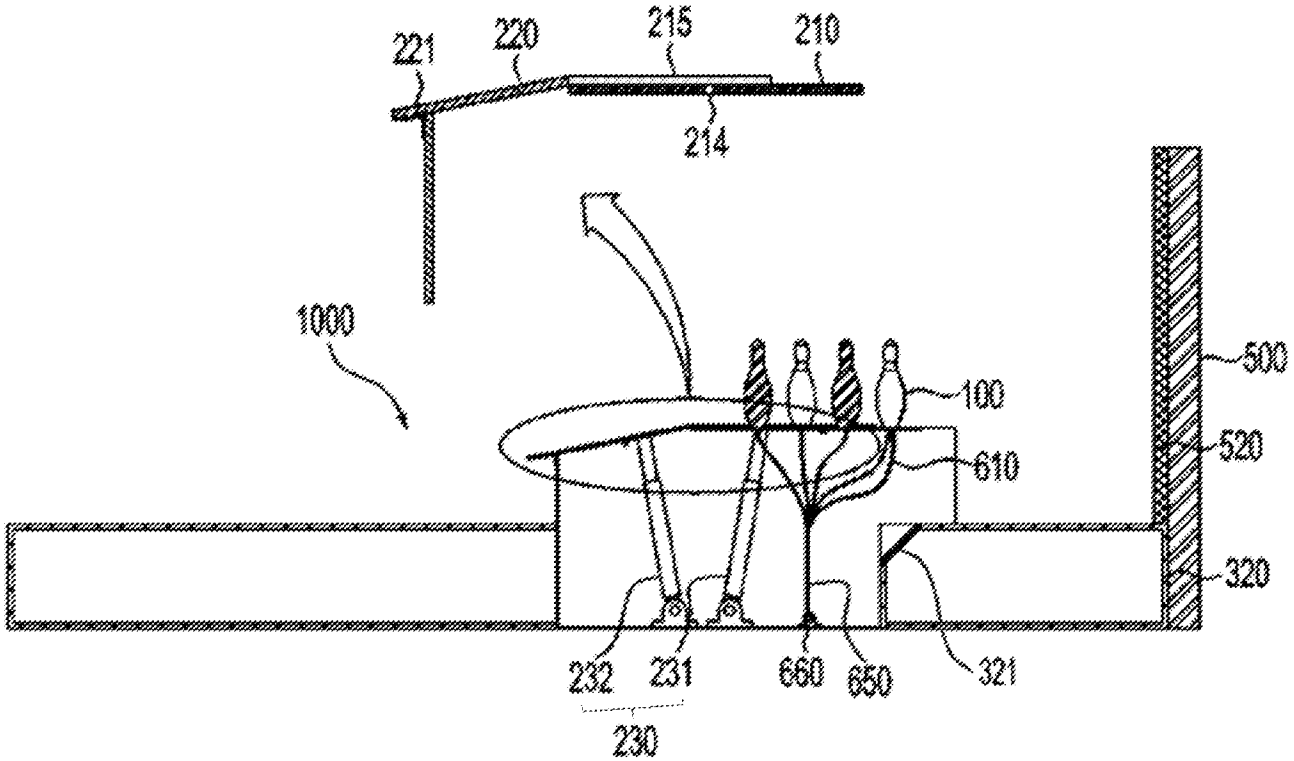
FIGS. 4 and 5 are side cross-sectional views illustrating the bowling game apparatus according to the embodiment of the present invention.
Figure 5:
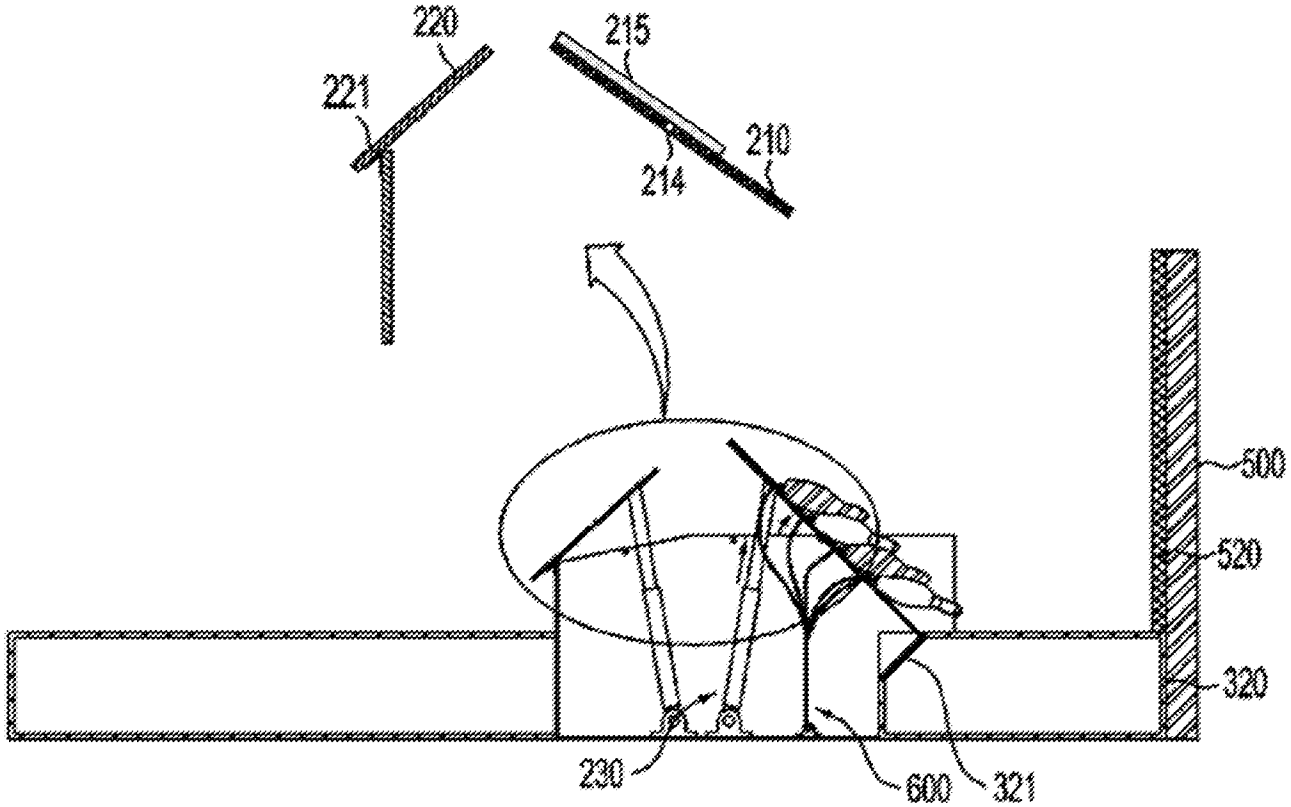
Figure 6:
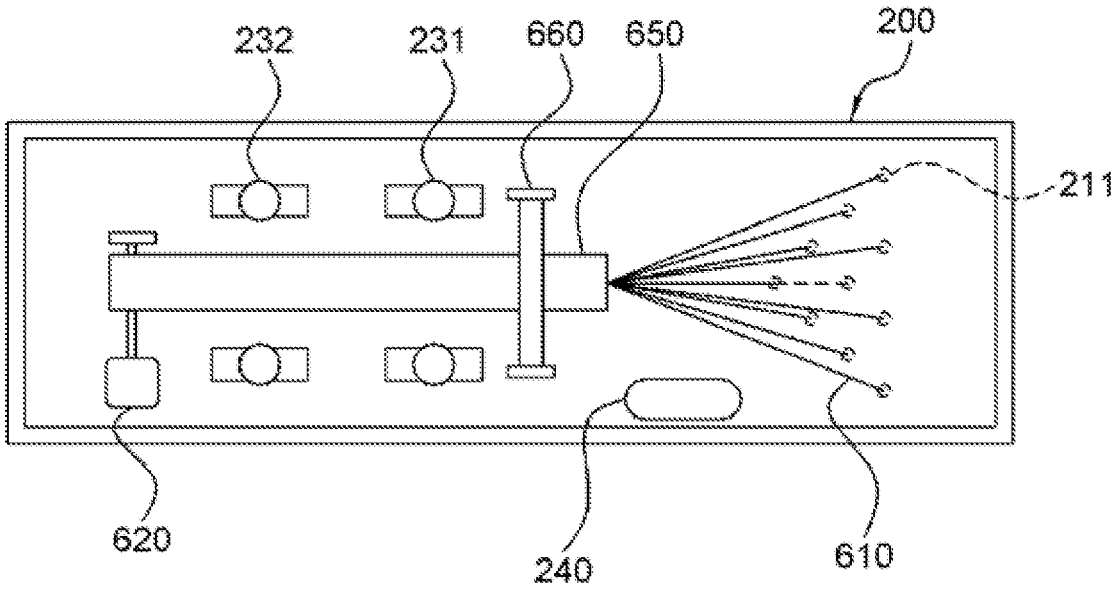
FIG. 6 is a flat cross-sectional view illustrating a body part according to an embodiment of the present invention.

FIGS. 4 and 5 are side cross-sectional views illustrating the bowling game apparatus 1000 according to the embodiment of the present invention, FIG. 6 is a flat cross-sectional view illustrating a body part according to the embodiment of the present invention, FIG. 4 illustrates the bowling game apparatus 1000 according to FIG. 1, and FIG. 5 illustrates the bowling game apparatus 1000 according to FIG. 2. In this case, referring to FIGS. 4 to 6, the bowling game apparatus 1000 is driven so that the pin deck 210 and the skip board 220 are driven to rotate in the front and rear directions to drop the flying disc 10 seated on the body part 200 to the swash plate 300, thereby dropping the flying disc 10 seated on the upper surface of the body part 200 downward.

In addition, the pin deck 210 further includes a passage guide block 215 formed to surround the front sides of the plurality of bowling pins 100 having a predetermined height and spaced apart from each other by a predetermined distance to guide the flying disc 10 to hit a portion spaced by a predetermined height upward from a lower end of the bowling pin 100, so the flying disc 10 hits the lower end of the bowling pin 100 that has a convex lower portion to have a low center of gravity, and thus, the bowling pin 100 is not subjected to sufficient force, thereby preventing the problem in that after the flying disc 10 hits the bowling pin 100, the hit bowling pin 100 or the surrounding bowling pins 100 are not collapsed, or the flying disc 10 does not pass through the upper portion of the pin deck 210.

In this case, the pin deck 210 further includes a rotation shaft 214 that is extended in the lateral direction and fixed so that both ends are rotatable to the body part 200, and may be configured to rotate in the front and rear directions based on the rotation shaft 214. The body part 200 may further include a rotation driver 230 that is coupled to a lower surface of the pin deck 210 at the front or rear with respect to the rotation shaft 214 to push or pull the pin deck 210 upward, thereby driving to rotate the pin deck 210. As illustrated, the rotation driver 230 may be configured to include a first cylinder 231 that rotates the pin deck and a second cylinder 232 that rotates the skip board 220 and may be modified as various driving devices without departing from the gist of the present invention.

In addition, the pin deck 210 is driven to rotate backward so that the flying disc 10 seated above the pin deck 210 is guided to drop to the rear swash plate 320 provided behind the body part 200, and the pin deck 210 may be lifted upward by making the rotation shaft 214 to be coupled to the rear surface of the body part 200 at one end of the rear thereof, and thus may be configured to rotate downward. It is preferable that the pin deck 210 rotates with respect to the rotation shaft that is configured to be spaced forward from the bottom forward by a predetermined distance, thereby minimizing a rotation radius at which the pin deck 210 is lifted upward. In this case, the rear portion of the pin deck 210 descends downward from the body part 200, and thus interferes with the front portion of the rear swash plate 320 provided at the rear of the pin deck 210. In order to prevent the problem, it is preferable that the rear swash plate 320 is provided with a collision prevention surface 321 formed so that the front portion thereof is inclined backward by a predetermined angle in order to prevent a collision with the rotating pin deck 210.

Figure 7:
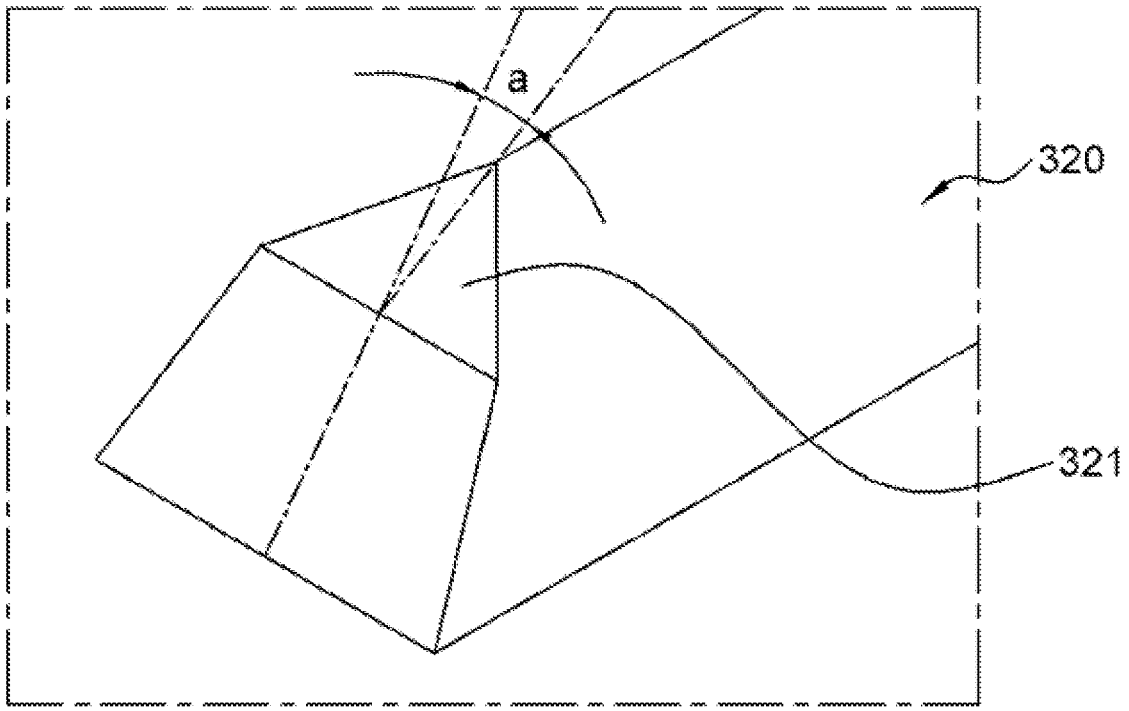
FIG. 7 is a perspective view for describing a rear inclined plate according to FIG. 5.

FIG. 7 is a perspective view for describing the rear swash plate 320 according to FIG. 5. As illustrated in FIG. 7, the collision prevention surface 321 is formed so that the front portion thereof forms a predetermined angle a from the ground. The predetermined angle a may be formed so as not to interfere with the rotation radius of the rear portion of the pin deck 210, so the rear swash plate 320 is aligned to extend forward by a predetermined interval toward the front of the pin deck 210, thereby preventing the flying disc 10 from being introduced into the body part 200 according to the rotation of the pin deck 210 and guiding the flying disc 10 from dropping in the lateral direction.

In addition, the skip board 220 provided in front of the pin deck 210 is also driven to rotate, so the flying disc 10 seated on the upper surface of the skip board 220 may be formed to drop downward. It is preferable that the skip board 220 is driven to rotate forward, and thus, the flying disc 10 seated on the upper surface of the skip board 220 drops to the front swash plate 310 provided in front of the body part 200. The skip board 220 may be configured to rotate in any one of the front and rear directions by coupling one surface in the front and rear directions to one surface of the body part 200 through a rotation hinge 221 as illustrated. It is preferable that the skip board 220 is rotatably fixed to the body part 200 using the rotation shaft like the pin deck 210 to minimize the rotation radius upward of the swash plate 210 and the skip board 210.

As described above, as the pin deck 210 of the body part 200 is driven to rotate, the bowling game apparatus 1000 according to the present invention is configured to further include a pinsetter unit 600 that fixes the bowling pin 100 to prevent the bowling pin 100 from deviating from the pin deck 210 when the pin deck 210 rotates and is driven to automatically erect the bowling pins 100 so that a user does not directly set the bowling pins 100.

Figure 8:
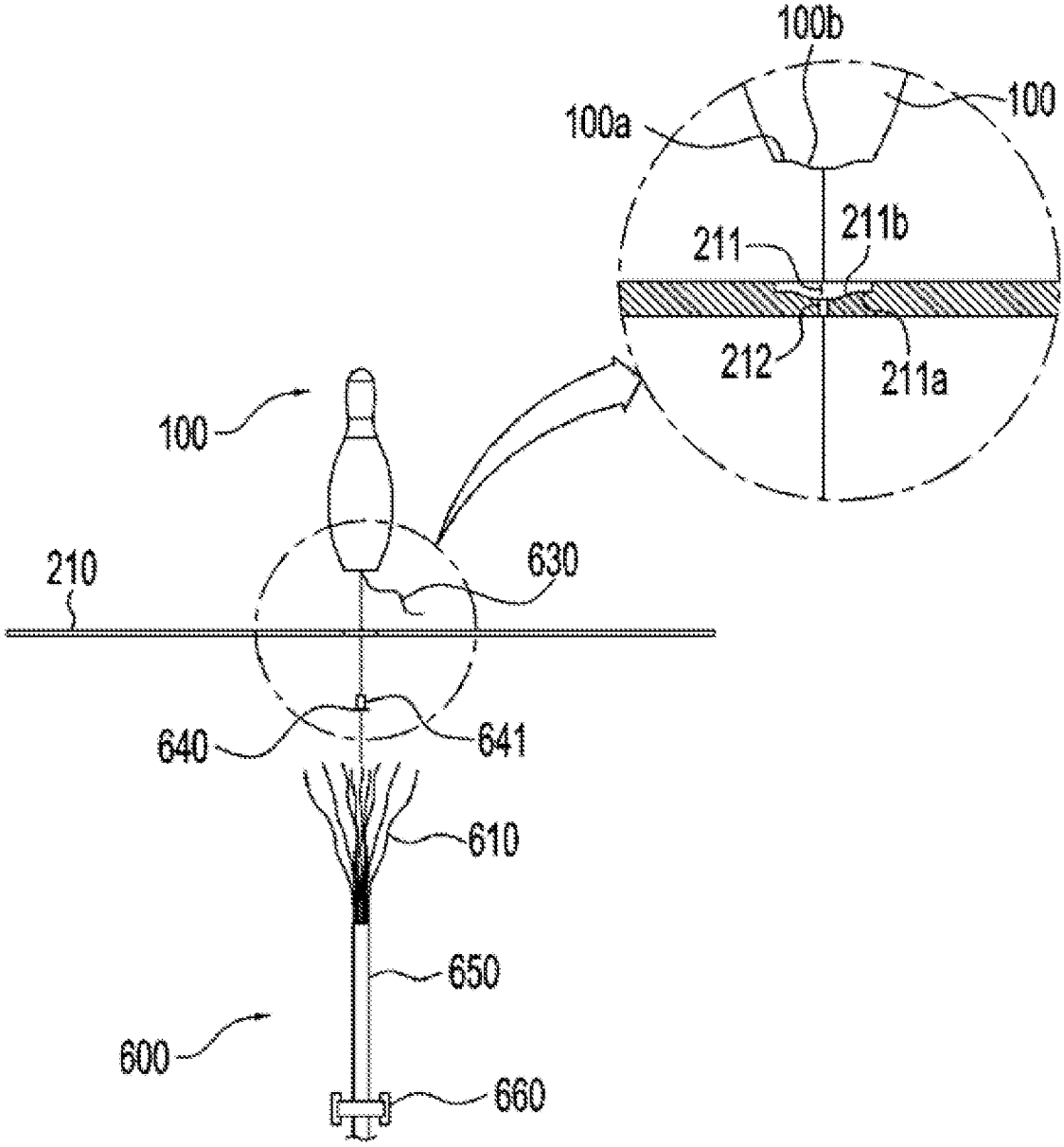
FIG. 8 is a configuration diagram for describing a pin-setter unit according to an embodiment of the present invention.

FIG. 8 is a configuration diagram for describing the pinsetter unit 600 according to an embodiment of the present invention. Referring to FIGS. 6 to 8, the pin deck 210 further includes a through hole 212 perforated so that a pin-up string 610 connected to the lower portion of the bowling pin 100 penetrates downward of the pin insertion groove 211, and the pinsetter unit 600 further includes a winding motor 620 that applies tension to the pin-up string 610 to prevent the bowling pin 100 from deviating from the pin deck 210 when the pin deck 210 rotates backward. When the pin deck 210 returns to an original position, the pinsetter unit 600 may set to operate the winding motor 620 to seat the bowling pin 100 on the pin insertion groove 211 of the pin deck 210 so that a user may perform the next game. In more detail, the pinsetter unit 600 further includes a pin separation prevention string 630 that has one end connected to the lower end of the bowling pin 100 and a pin separation prevention ring 640 that is connected to the winding motor 620 by connecting the pin-up string 610 to the other end of the pin separation prevention string 630 and is provided on the lower portion of the pin deck 210 to adjust a distance at which the bowling pin 100 is separated from the pin deck 210, so that bowling pin 100 may be separated by a predetermined distance when the bowling pin 100 is collapsed by the flying disc 10 or the pin deck 210 rotates. In this case, it is preferable that the pin separation prevention ring 640 further includes a cushioning rubber 641 for alleviating the impact to the pin deck 210 due to the separation of the bowling pin 100 at the upper portion thereof. The pin separation prevention ring 640 and the cushioning rubber 641 are formed to have a larger cross-sectional area than that of the through hole 212 of the pin deck 210.

In addition, the pin separation prevention string 630 is preferably made of a material that does not have elasticity. After the flying disc 10 is hit to be collapsed, the bowling pin 100 is prevented from unnecessarily moving due to the elasticity of the pin separation prevention string 630. On the other hand, the pin-up string 610 may be made of a material having elasticity. It is preferable that the plurality of pin separation prevention strings 630 and pin-up strings 610 are respectively connected to the lower ends of the plurality of bowling pins 100. The pinsetter unit 600 may further include a pulling belt 650 that accommodates the plurality of pin-up strings 610 therein, and surrounds the outside so that the plurality of pinsetter strings 610 are not tangled. The pulling belt 650 is provided in the body part 200 below the pin deck 210 to be connected to the belt roller 660 formed to vertically fix the pin-up strings 610 in the vertical direction, so that the tension of the winding motor 620 may act on the pin-up strings 610 in the vertical direction. In this case, it is preferable that the pin separation prevention string 630 is formed long enough so as not to have a tight tension when the bowling pin 100 is seated and erected in the pin insertion groove 211 of the pin deck 210, and thus the bowling pin 100 is formed to be collapsed by the flying disc 10.

In addition, the pinsetter unit 600 is configured to individually wind the plurality of pin-up strings 610 so that the plurality of bowling pins 100 may be individually controlled, thereby primarily preventing the bowling pins 210 from being collapsed by the thrown flying disc 10 and erecting only the remaining bowling pins and secondarily making spare processing by throwing the flying disc 10. In this case, in general, in the bowling game apparatus, the flying disc 10, which is primarily thrown, drops in the left and right directions or the front and rear directions, and even when the flying disc 10 is seated on the upper surface of the body part 200, a volume of the flying disc 10 is not large, and therefore, the pin deck 210 does not rotate, and it is preferable that the flying disc 10 is secondarily thrown to hit the remaining bowling pins 100, and then the pin deck 210 rotates to progress the alignment of the bowling pins 100 and the recovery of the seated flying disc 10. However, if necessary, it is driven to control the tension of the plurality of pin-up strings 610, respectively, for the abnormal operation or manual control of the bowling game apparatus 1000, the plurality of pin-up strings 610 may each be driven to be controlled and thus the settings of the plurality of bowling pins 100 may each be controlled. In this case, as a method for controlling the settings of the plurality of bowling pins 100, respectively, as described above, the pin separation prevention strings 630 each connected to the bowling pins 100 are each wound or rollers around which each pin separation prevention string 630 are partitioned, so the rollers partitioned on the rotation shaft of the winding motor 620 may be controlled to rotate or not rotate in parallel, which may be performed using various means other than the above-described method. The present invention is not limited by the above-described driving methods without departing from the gist of the present invention, and may be variously modified.

In addition, the pin insertion groove 211 of the pin deck 210 prevents the bowling pin 100 from being collapsed due to unnecessary vibration, shock, or the like from the outside when the bowling pin 100 is seated and erected. In order to prevent the shaking of the bowling pin 100, the pin insertion groove 211 may be configured to include a stepped portion 211*a* vertically formed with an outer portion of the end surface in the vertical direction of the pin insertion groove 211 and a curved portion 211*b* concavely formed with an inner portion of the end surface downward. In this case, it is preferable that the lower portion 110 of the bowling pin 100 is also provided with a convex portion 110*b* whose the lower portion is partially convexly formed downward and a fitting portion 110*a* having a predetermined height and vertically formed on the outside of the convex portion 110*b*, corresponding to a stepped portion 211*a* and a curved portion 211*b* of the pin insertion groove 211.

In this case, by the pin-up strings 610 connected to the lower end of the bowling pins 100, the flying disc 10 is caught on the bowling pins 100 when the pin deck 210 rotates, or the bowling pins 100 may be tangled and thus, the recovery of the flying disc 10 and the pin setting may not be performed smoothly. Therefore, in order to solve the above-described problems, the bowling game apparatus 1000 of the present invention may be configured to inject high-pressure air toward the upper surface of the pin deck 210 after the rotation of the pin deck 210 or to vibrate the pin deck 210 to align the bowling pins 100 so that they are not tangled, and to drop the flying discs 10 caught on the bowling pins 100 downward.

In more detail, the pin deck 210 may be configured to include a plurality of air injection holes 213 formed to inject air of a predetermined pressure upward when rotating in the front and rear directions and a compressor 240 connected to the plurality of air injection holes 213 to inject the compressed air. In this case, the compressor 240 may be integrally connected by using various types of joints that connect a plurality of pipes connected to the plurality of air injection holes 213.

In addition, the other means for aligning the bowling pin 100 and for preventing the flying disc 10 from being caught is provided with a vibrator 250 for vibrating the pin deck 210, and when the pin deck 210 rotates, by vibrating the pin deck 210, the bowling pins 100 dropped downward by their own weight may be shaken and aligned, so there is an advantage in that the bowling pins 100 are shaken so that the flying disc 10 caught on the bowling pins 100 drops downward. In this case, the vibrator 250 is not illustrated in the drawing, but may be configured to be attached to the lower surface of the pin deck 210 or coupled to both ends of the rotation shaft of the pin deck 210 to move the rotation shaft 214 in the left and right directions and may be variously modified in various forms without departing from the gist of the present invention.

Figure 9:
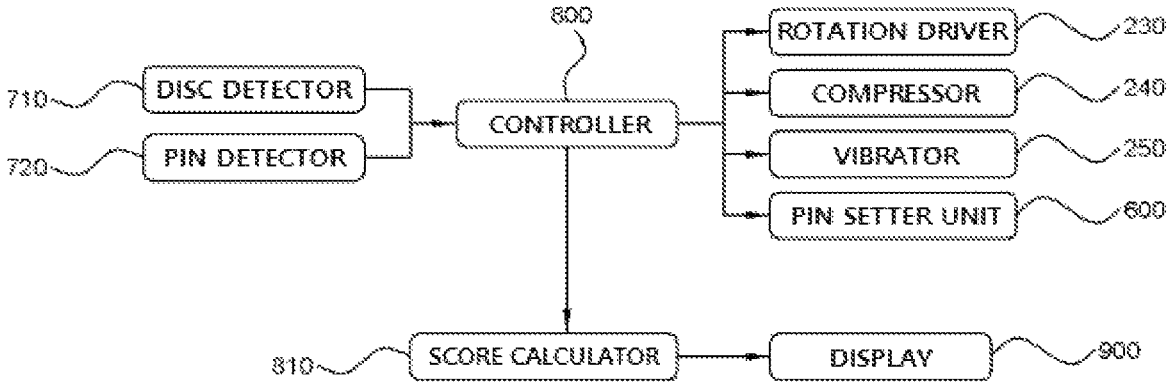
FIG. 9 is a block diagram illustrating the bowling game apparatus according to the embodiment of the present invention.

FIG. 9 is a block diagram illustrating the overall configuration of the bowling game apparatus 1000 according to the embodiment of the present invention, and the driving of the bowling game apparatus 1000 will be described in more detail below with reference to FIG. 9.

The bowling game apparatus 1000 according to the present invention may be configured to further include a disc detector 710 that detects the flying disc 10, a pin detector 720 that detects the bowling pin 100 hit by the flying disc 10 and is collapsed, a controller 800 that is applied with signals detected by the disc detector 710 and the pin detector 720 to control the driving of the rotation driver 230 and the pinsetter unit 600, a score calculator 810 that calculates a bowling game score by receiving the number of bowling pins 100 collapsed at the controller 800, and a display 900 that displays the calculated score.

The disc detector 710 may include an observation sensor that observes a path through which the flying disc 10 flies, and detects that the flying disc 10 passes on the observed path. In this case, the controller 800 may determine the number of times the flying disc is thrown by receiving the signal detected by the disc detector 710, and control to operate the rotation driver 230 and the pinsetter unit 600 when the flying disc is thrown twice, the rotation driver 230 and the pinsetter unit 600. In this case, the rotation driver 230 includes the first and second cylinders 231 and 232, the compressor 240 and the vibrator 250, and the pinsetter unit 600 includes a configuration for performing the setting of the bowling pin such as the winding motor 620.

The pin detector 720 is a configuration for detecting the bowling pin 100 collapsed by allowing the flying disc 10 to hit the bowling pin 100, and may detect the bowling pins 100 other than the collapsed bowling pins 100 by observing a predetermined height of the plurality of bowling pins 100 erected on the pin deck 210. In this case, the sensors of the disc detector 710 and the pin detector 720 are not limited to one method, and may be modified using various means without departing from the gist of the present invention. In addition, the controller 800 may receive signals detected by the disc detector 710 and the pin detector 720, and control to operate the rotation driver 230 and the pinsetter unit 600 according to the order of operation of the bowling game. In more detail, after detecting the throwing of the flying disc two or more times, after a predetermined time, or after detecting the collapse of the bowling pin 100, the controller 800 may control to operate the rotation driver 230 and the pinsetter unit 600.

In addition, the controller 800 transfers the number of the bowling pins 100 that have collapsed according to the number of throws of the flying disc 10 to the score calculator 810, and the score calculator 810 may display the score calculated according to the number of times of the throwing of the flying disc 10 and the number of collapsed bowling pins 100, which are applied from the controller 800, on the display 900.

The present invention is not limited to the above mentioned exemplary embodiments, but may be variously applied, and may be variously modified without departing from the gist of the present invention claimed in the claims.

DETAILED DESCRIPTION OF MAIN ELEMENTS

| | |
|---|---|
| 1000: Bowling game apparatus | |
| 100: Bowling pin | |
| 200: Body part | |
| 210: Pin deck | 211: Pin insertion groove |
| 211a: Stepped portion | 211b: Curved portion |
| 212: Through hole | 213: Air injection hole |
| 214: Rotation shaft | 215: Passage guide block |
| 220: Skip board | 221: Rotation hinge |
| 230: Rotation driver | 231: First cylinder |
| 232: Second cylinder | |
| 240: Compressor | 250: Vibrator |
| 300: Swash plate | 310: Front swash plate |
| 320: Rear swash plate | 321: Collision prevention surface |
| 400: Recovery conveyor | |
| 500: Dropping wall | 510: Pillar |
| 520: Shock absorbing member | |
| 600: Pinsetter unit | 610: Pin-up string |
| 620: Winding motor | 630: Pin separation prevention string |
| 640: Pin separation prevention ring | 641: Cushioning rubber |
| 650: Pulling belt | 660: Belt roller |
| 710: Disc detector | 720: Pin detector |
| 800: Controller | 810: Score calculator |
| 900: Display | |

The invention claimed is:

1. A bowling game apparatus for a flying disc configured to automatically collect the flying disc that hits bowling pins erected spaced apart at a certain distance and then is dropped, the bowling game apparatus comprising:

a body part configured to include a pin deck having a pin insertion groove inserted thereinto for erecting a bowling pin on an upper surface thereof;

a skip board configured to be provided in front of the pin deck and formed so that a front portion thereof is inclined downward by a predetermined angle;

a swash plate configured to include a front swash plate provided in front of the body part and a rear swash plate provided at a rear of the body part, wherein each of the front swash plate and the rear swash plate has an inclined surface inclined at a predetermined angle with a ground; and a recovery conveyor configured to be provided in a lateral direction of the body part and the swash plate to collect the flying disc dropping by the swash plate, wherein the pin deck and the skip board are configured to be each rotatable in front and rear directions, wherein the body part further includes a rotation driver configured to include a first actuator that rotates the pin deck and a second actuator that rotates the skip board, wherein the pin deck is driven to rotate backward by the first actuator, and wherein the skip board is driven to rotate forward by the second actuator to drop the flying disc seated on the body part.

2. The bowling game apparatus of claim 1, wherein the pin deck further includes a rotation shaft extending in a lateral direction so that both ends thereof are rotatably fixed to the body part, wherein the pin deck rotates in front and rear directions with respect to the rotation shaft to drop the flying disc seated on the pin deck onto the swash plate.

3. The bowling game apparatus of claim 2, further comprising:

a pinsetter unit configured to set the bowling pin erected on the pin deck and to prevent the bowling pin from being separated when the pin deck rotates, including a winding motor that applies tension to a pin-up string connected to the bowling pin, wherein the pin deck further includes a through hole perforated so that a pin-up string connected to a lower portion of the bowling pin penetrates downward of the pin insertion groove.

4. The bowling game apparatus of claim 3, wherein the pin deck further includes a plurality of air injection holes formed to inject air of a predetermined pressure upward when rotating in the front and rear directions to cause the flying disc that has not dropped after the rotation of the pin deck to deviate from the pin deck.

5. The bowling game apparatus of claim 3, wherein the body part further includes a vibrator configured to vibrate the pin deck when the pin deck rotates in the front and rear directions to cause the flying disc that has not dropped after the rotation of the pin deck to deviate from the pin deck.

6. The bowling game apparatus of claim 1, further comprising:

a dropping wall configured to be provided in at least one of rear or side directions of the body part, the swash plate, and the recovery conveyor to drop the flying disc deviated without hitting the bowling pin onto the swash plate or the recovery conveyor.

7. The bowling game apparatus of claim 6, wherein the dropping wall further includes a shock absorbing member provided on an inner side surface of the dropping wall to absorb the shock of the hitting flying disc.

8. The bowling game apparatus of claim 1, wherein the pin insertion groove of the pin deck includes a stepped portion in which an outer side portion of a cross section in a vertical direction is vertically formed, and a curved portion in which an inner side portion of the cross section is formed to be recessed downward.

* * * * *